US007396048B2

(12) United States Patent
Janetzke et al.

(10) Patent No.: US 7,396,048 B2
(45) Date of Patent: Jul. 8, 2008

(54) INTERNET STAMP

(75) Inventors: Jason Janetzke, Springboro, OH (US); David L. Christianson, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 727 days.

(21) Appl. No.: 10/270,944

(22) Filed: Oct. 15, 2002

(65) Prior Publication Data

US 2004/0070194 A1 Apr. 15, 2004

(51) Int. Cl.
*G09F 3/04* (2006.01)

(52) U.S. Cl. ..... 283/71; 283/72; 283/81; 283/92; 283/902; 428/42.1; 428/690; 428/916; 40/638

(58) Field of Classification Search ..... 283/71, 283/72, 81, 92, 93, 67, 902; 428/42.1, 690, 428/915, 916; 40/638
See application file for complete search history.

(56) References Cited

U.S. PATENT DOCUMENTS

| | | | | | |
|---|---|---|---|---|---|
| 3,713,861 | A | | 1/1973 | Sharp | |
| 4,872,706 | A | * | 10/1989 | Brewen et al. | 283/81 |
| 5,018,767 | A | * | 5/1991 | Wicker | 283/67 |
| 5,193,853 | A | * | 3/1993 | Wicker | 283/85 |
| 5,271,645 | A | * | 12/1993 | Wicker | 283/92 |
| 5,685,570 | A | * | 11/1997 | Gray et al. | 283/71 |
| 5,708,717 | A | * | 1/1998 | Alasia | 380/51 |
| 5,712,916 | A | * | 1/1998 | Windel et al. | 380/51 |
| 5,902,439 | A | * | 5/1999 | Pike et al. | 156/252 |
| 5,919,730 | A | * | 7/1999 | Gasper et al. | 503/201 |
| 5,932,139 | A | * | 8/1999 | Oshima et al. | 252/301.16 |
| 6,010,156 | A | * | 1/2000 | Block | 281/2 |
| 6,030,000 | A | * | 2/2000 | Diamond | 283/58 |
| 6,039,257 | A | * | 3/2000 | Berson et al. | 235/468 |
| 6,142,380 | A | * | 11/2000 | Sansone et al. | 235/487 |
| 6,203,069 | B1 | * | 3/2001 | Outwater et al. | 283/88 |
| 6,209,920 | B1 | * | 4/2001 | Fabel | 283/62 |
| 6,244,763 | B1 | * | 6/2001 | Miller | 400/76 |
| 6,303,202 | B1 | * | 10/2001 | Washburn et al. | 428/40.1 |
| 6,409,592 | B1 | * | 6/2002 | McCoy et al. | 462/6 |
| 6,424,954 | B1 | * | 7/2002 | Leon | 705/401 |
| 6,428,219 | B1 | * | 8/2002 | Stier et al. | 400/76 |
| 6,461,063 | B1 | * | 10/2002 | Miller et al. | 400/76 |

(Continued)

FOREIGN PATENT DOCUMENTS

DE 4215834 A1 * 11/1993

(Continued)

OTHER PUBLICATIONS

Leon, J.P. et al., U.S. Appl. No. 09/611,375, Providing Stamps on Secure Paper Using a Communications Network, filed Jul. 7, 2000, specification pp. 1-23.*

(Continued)

*Primary Examiner*—Monica Carter
*Assistant Examiner*—Eric A. Gates
(74) *Attorney, Agent, or Firm*—Francis L. Conte

(57) ABSTRACT

A postage sheet includes a face sheet adhesively bonded to a release liner. The face sheet includes a removable internet stamp having a diecut perimeter. A visible security indicium is disposed on the front side of the stamp and has a different color than the face sheet, and is not reproducible by photocopying.

25 Claims, 2 Drawing Sheets

U.S. PATENT DOCUMENTS

| | | | | |
|---|---|---|---|---|
| 6,481,753 | B2 * | 11/2002 | Van Boom et al. | 283/72 |
| 6,505,179 | B1 * | 1/2003 | Kara | 705/50 |
| 6,541,091 | B2 * | 4/2003 | Washburn et al. | 428/40.1 |
| 6,594,374 | B1 * | 7/2003 | Beckstrom et al. | 382/101 |
| 6,659,507 | B2 * | 12/2003 | Banahan | 283/81 |
| 6,692,033 | B2 * | 2/2004 | Miller et al. | 283/116 |
| 6,701,304 | B2 * | 3/2004 | Leon | 705/401 |
| 6,712,399 | B1 * | 3/2004 | Drinkwater et al. | 283/111 |
| 6,733,867 | B2 * | 5/2004 | Pinell et al. | 156/240 |
| 6,736,067 | B2 * | 5/2004 | Patton | 101/483 |
| 2001/0032871 | A1 * | 10/2001 | Miller et al. | 229/71 |
| 2002/0040353 | A1 * | 4/2002 | Brown et al. | 705/401 |
| 2002/0056988 | A1 * | 5/2002 | Patton | 283/71 |
| 2002/0073039 | A1 | 6/2002 | Ogg et al. | |
| 2002/0149195 | A1 * | 10/2002 | Beasley | 283/71 |
| 2003/0167179 | A1 * | 9/2003 | Briley | 705/1 |

FOREIGN PATENT DOCUMENTS

EP 1414777 * 11/1975

OTHER PUBLICATIONS

NCR Systemedia, "New Security Feature Program," Marketing Communication, Feb. 16, 1998, 30 pages.
NCR Corp., "Internet Postage Mailing and Shipping Labels," NCR No. 903178, 2000, 2 cover sheets, and sample label sheet.
NCR Corp., "Internet Postage Window Envelope Labels," NCR No. 903194, 2000, 2 cover sheets, instruction sheet, and sample label sheet.
NCR Corp., "Pepboys," sample thermalchromatic ink sheet roll, commercially available for more than one year before Oct. 15, 2002.
NCR Corp., sample labels with white ink on white label, commerically available for more than one year before Oct. 15, 2002.
USPS, "Postage Solutions," Jul. 12, 2002, website page.
Federal Register, vol. 65, No. 191, Oct. 2, 2000, pp. 58687—'88.

* cited by examiner

INTERNET STAMP

BACKGROUND OF THE INVENTION

The present invention relates generally to mailing services, and, more specifically, to postage therefor.

The United States Postal Service (USPS) requires suitable prepaid postage visibly attached to various forms of mailers such as envelopes and packages for delivery thereof. The ubiquitous postage stamp is issued in various monetary denominations and is simply adhesively bonded to the mailer in accordance with the total weight thereof.

High volume commercial senders typically use a postage meter for imprinting or stamping the required postage on the individual mailed pieces. The postage meter permits easy printing of the exact postage required for a given weight, but requires the additional expense of the postage meter itself and subscription to a service for replenishing the monetary value therein.

In order to bring self-service postage capability to the typical consumer, the USPS has been developing with the industry improved postage media. For example, various forms of internet postage approved for use by the USPS have been available for purchase by typical consumers for well over a year. The consumer purchases from a stationery supplier a sheet of pressure sensitive mailing labels and corresponding postage labels. The consumer uses a personal computer to access the USPS through the common internet for electronically purchasing postage.

In this way, the consumer may print at home using the typical personal printer, such as inkjet or laser printer, both the mailing label and corresponding postage label for one or more pieces to be mailed.

However, downloading of internet postage requires suitable security to prevent fraudulent use or copying of the postage labels which would deprive the USPS of due compensation. Accordingly, the USPS requires suitable security measures for the internet postage to minimize or prevent the likelihood of fraudulent use.

For example, the conventional internet postage label presently approved by the USPS must be used in conjunction with a corresponding mailing label of authorized configuration and design. The postage label itself may not be used without the corresponding mailing label or it will not be accepted for delivery.

Two forms of authorized internet postage include a generally L-shaped postage label and corresponding rectangular return label. The second version introduces a third mailing label for the recipient. The two-part label or the three-part label must all be used in a typical internet transaction for downloading suitable postage for the intended mailer.

The postage label itself must conform with many specifications required by the USPS for permitting its convenient use in automated handling in the postal service. Security features for the L-shaped postage label include its shape and a printed two dimensional barcode containing data encoded therein for identifying the transaction. Furthermore, the postage label once printed must typically be delivered to the USPS within 24 hours of printing, again for security reasons.

Although the present internet postage media permits the typical consumer to prepare postage at home using a personal computer, the multi-part label and procedure increases the complexity and cost thereof.

Recognizing these shortcomings, the USPS is actively cooperating with the industry to further develop the efficiency of internet postage.

Accordingly, it is desired to provide an improved internet postage media having improved security features for permitting its use alone on a mailer.

BRIEF SUMMARY OF THE INVENTION

A postage sheet includes a face sheet adhesively bonded to a release liner. The face sheet includes a removable internet stamp having a diecut perimeter. A visible security indicium is disposed on the front side of the stamp and has a different color than the face sheet, and is not reproducible by photocopying.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
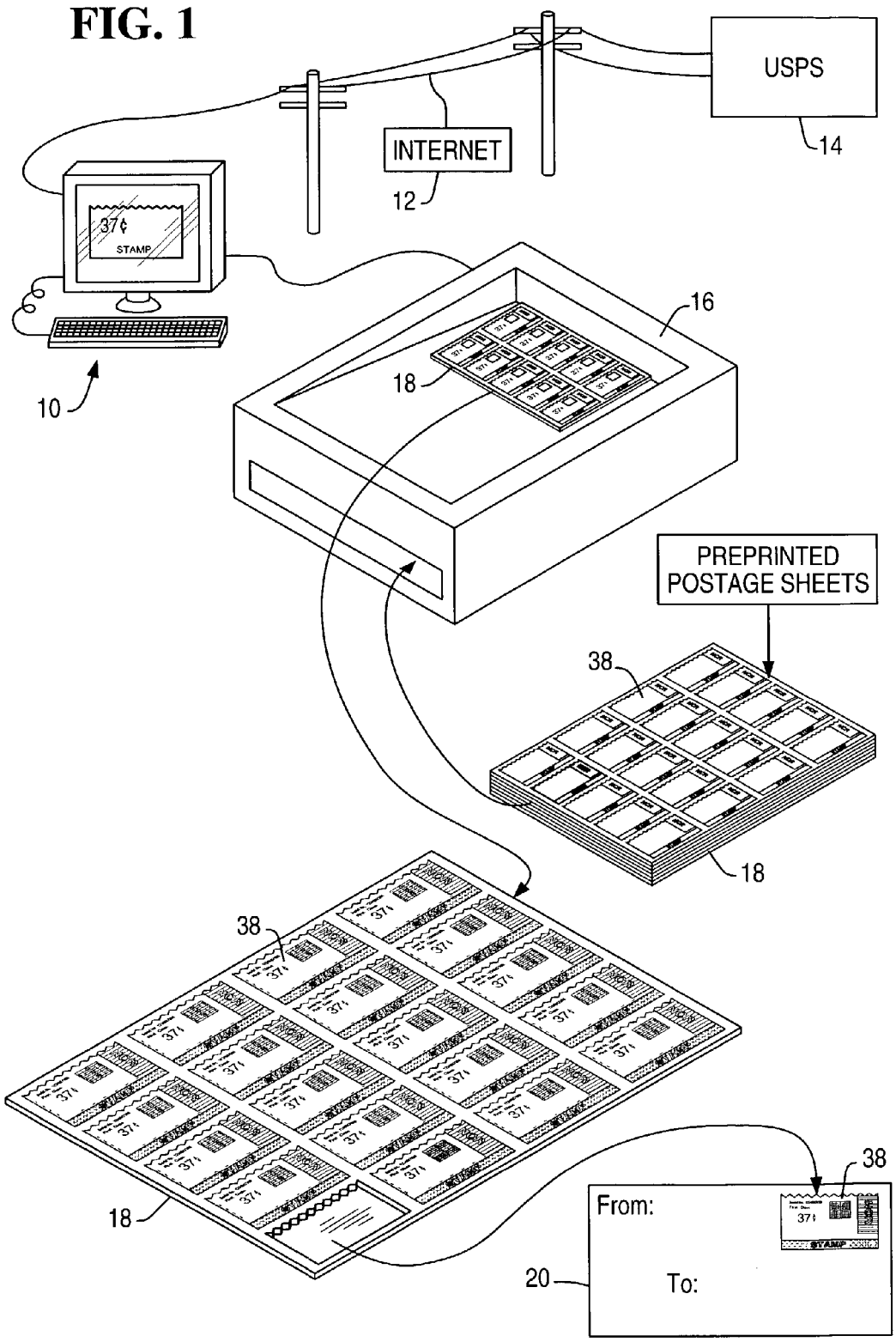
FIG. 1 is a schematic representation of a system for printing internet postage from a personal computer in accordance with one embodiment of the present invention.

Illustrated schematically in FIG. 1 is a system for printing internet postage by a typical consumer at home. A conventional personal computer (PC) 10 may have any conventional configuration including a modem for accessing the ubiquitous internet 12 through ordinary telephone lines, for example. The PC 10 includes suitable software for communicating with the USPS 14 for downloading internet postage in accordance with procedures approved by the USPS. Operatively joined to the PC 10 is a printer 16 which may have any conventional form such as an inkjet printer or laser printer.

In accordance with the present invention, the consumer may purchase from a local stationery supplier one or more preprinted postage sheets 18 which may be loaded into the printer individually or in a stack. The PC may be used to download postage from the USPS through the internet using any suitable form of payment. The PC may then be used for printing the required amount of postage on one of the postage sheets, which postage may then be placed on any suitable mailer 20 such as a typical envelope, postcard, or package in any form acceptable to the USPS.

Figure 2:
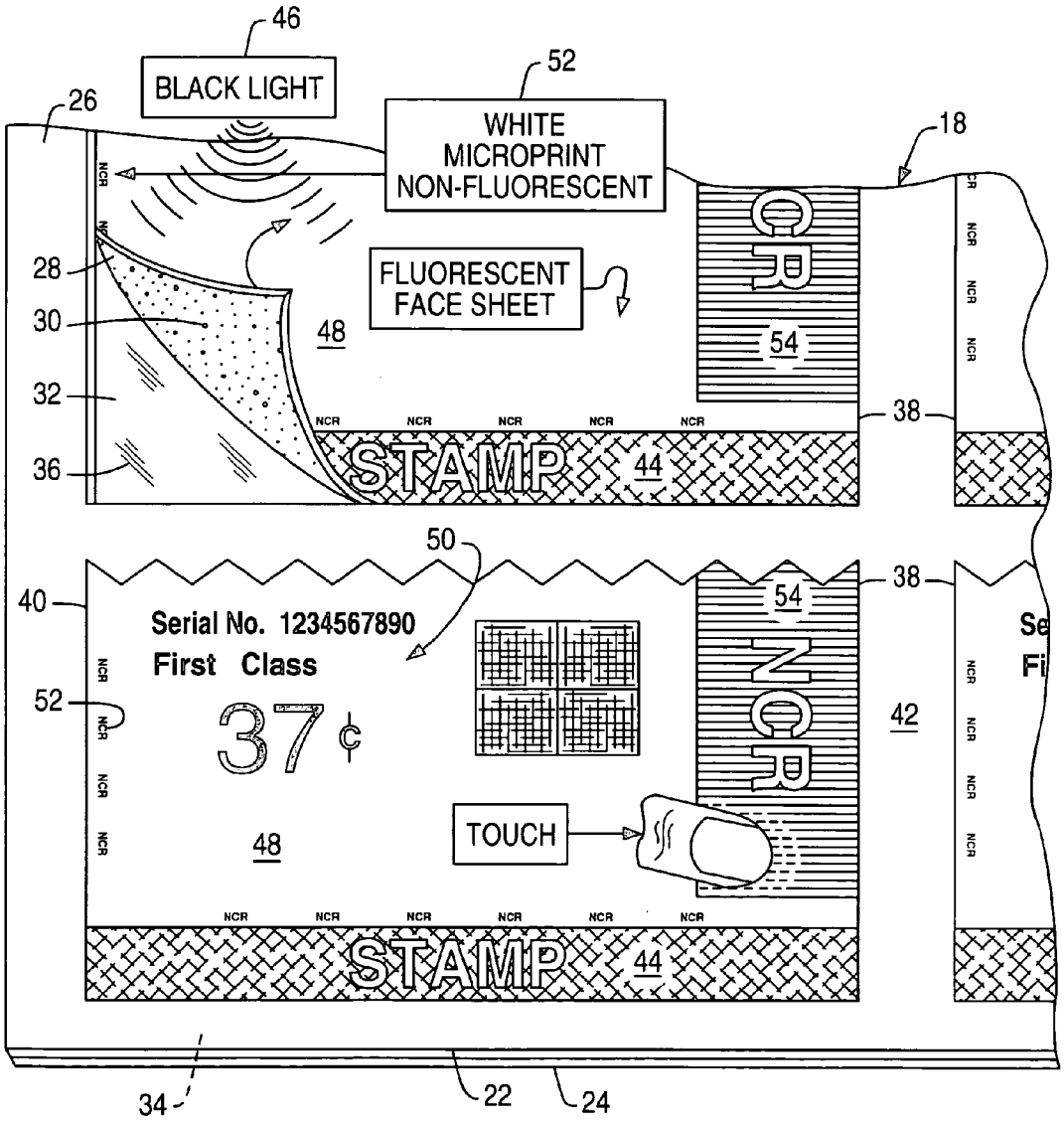
FIG. 2 is an enlarged plan view of a portion of the postage sheet illustrated in FIG. 1 printed with internet postage in accordance with a preferred method.

FIG. 2 illustrates in enlarged form a portion of the postage sheet illustrated in FIG. 1 in accordance with an exemplary embodiment. The postage sheet is a laminate of a paper face sheet or overlay 22 adhesively bonded to an underlying release liner 24.

The face sheet includes an exposed front side 26, and an opposite back side 28. The back side is suitably covered with an adhesive 30, such as conventional pressure sensitive adhesive which will form a permanent bond on the mailer illustrated in FIG. 1 when adhered thereto.

The release liner 24 may have any conventional configuration, such as supercalendered kraft (SCK) paper, with a front side 32 and an opposite, exposed back side 34. The liner front side is covered with a release agent 36, such as silicone, and is bonded or laminated to the back side of the face sheet by the adhesive therebetween.

In accordance with the present invention, the face sheet includes a removable internet or postage stamp 38 having a diecut perimeter 40 which permits its ready removal from the underlying release liner without tearing from the face sheet.

In the preferred embodiment illustrated in FIGS. 1 and 2, the postage sheet 18 includes a plurality of the internet stamps 38 arranged in a rectangular array on the face sheet, with each stamp having a respective diecut perimeter and being separately removable from the common liner. For example, the postage sheet 18 may have any suitable size, such as 8½×11 inches, and includes as many internet stamps as practical over the surface area of the face sheet thereof. Twenty exemplary internet stamps in a four-stamp-by-five-stamp array is illustrated in FIG. 1 for example.

As shown in FIG. 2, the face sheet 22 preferably includes a scrap border 42 surrounding each of the stamps which permits overprinting of the stamps along the border. In this way, larger printing tolerances may used for ease of manufacture, and, the individual stamps may be printed completely to their perimeters for maximizing the available printing space on each stamp.

Although the postage sheet preferably includes several internet stamps, the sheet may be otherwise configured for as few as one internet stamp. And, the postage sheet may be in roll form with a series of internet stamps thereon for improving the use thereof in a dedicated printer specifically configured therefor.

FIG. 2 illustrates the internet stamp 38 in an exemplary configuration, which stamp must comply with all required specifications promulgated by the USPS. For example, the USPS requires a facing feature in the stamp for permitting automated scanning in the USPS. A conventional facing feature is fluorescent coloring, and may be in the form of an orange band 44 that runs along the bottom horizontal edge of the stamp. The orange band fluoresces under a typical black light 46, and meets the USPS facing requirement for automated handling.

Each internet stamp illustrated in FIG. 2 also includes a postage site 48 which is initially blank for permitting later printing of an internet postage indicia 50 thereon. The postage indicia is downloaded through the internet and printed on demand by the consumer on the individual stamp for providing postage for a specific mailer. The indicia includes the amount of postage, the class of mailing, and a two dimensional (2D) barcode having suitable information associated with the internet postage. The postage indicia may have any form as required by the USPS.

Since the internet stamp is specifically configured for being generated by a consumer, the USPS requires suitable security features therein for preventing fraudulent use of the stamp or unauthorized copying or duplication thereof. For example, one simple security feature is the scalloped edge of the stamp illustrated in FIG. 2 which increases the difficulty of reproducing the stamps from ordinary label sheets.

Another security feature is the serial number for the stamp which is preprinted by the manufacturer along the postage site. Yet another security feature is the pressure sensitive adhesive configured for forming a substantially permanent bond on the mailer so that attempts to remove the stamp will tear or otherwise damage the stamp.

Since the USPS is actively cooperating with the industry for improving internet postage, additional security features are being explored by the industry. Various security features are commonly known in the industry and may be proposed in internet postage designs for approval by the USPS. For example, microprinting of small text that would not be properly scanned by a photocopier because of its tiny size is commonly found in financial checks and could be introduced in internet postage. Another security feature that could be introduced in internet postage is the watermark which is also commonly found in financial checks to prevent its reproduction by photocopying.

The different security features disclosed above have different advantages and disadvantages for internet postage. An improved security feature in accordance with the present invention is a visible security patch or indicium 52,54 which is different in color than the face sheet itself, and is not reproducible by common electrostatic photocopying in the typical photocopier which uses toner. Toner-based monochrome or color photocopiers are commercially available and may be used for fraudulently duplicating internet postage unless suitable security features are provided.

The postage sheets illustrated in FIGS. 1 and 2 are typically purchased by the consumer and are preprinted with any desired information such as the orange facing bands 44 and serial numbers. The postage site 48 on each of the internet stamps is preferably blank when provided to the user. The security indicium 52,54 is also preprinted by the manufacturer adjacent to the postage site 48 prior to purchase by the consumer. The preprinted security indicia 52,54 may therefore include attributes which prevent their fraudulent reproduction.

In the preferred embodiment illustrated in FIG. 2, the face sheet 22 including the blank postage site 48 has an ordinary white color typically associated with conventional bond paper. A first security indicium 52 is a different shade or hue of white, and may be readily printed atop the face sheet using any form of conventional white ink. It is to be noted that for clarity of presentation in this disclosure, the white security indicium 52 is represented by visible black print, when in reality it would be white print and imperceptible to the untrained eye. The white security indicium 52 has the significant advantage that photocopying of the internet stamp cannot reproduce the different hues of white, with a photocopied stamp having a single hue of white obliterating the original distinction between the white indicium and the white face sheet.

The first security indicium 52 is preferably also minuscule in size, and not readily visible to the untrained eye. Unless trained to detect the tiny security indicium 52, most observers would fail to detect the difference in white color.

To further enhance the security effect of the indicium 52, it preferably comprises microprint characters such as alphabetical, numeric, or even graphical features, of such small size that even if formed of typical black ink, photocopying thereof would not properly duplicate or reproduce the fine features thereof. Microprint characters are typically up to about 4 point in character size, and microprint white characters have a synergistic affect for security. The white color of the indicium 52 is not readily distinguishable in a photocopier, and the small microprint size thereof is below the resolution capability of ordinary photocopiers.

As illustrated in FIG. 2, the stamp 38 has a horizontal orientation for printing the postage indicia 50 horizontally thereon for proper reading by the observer, and the security indicium 52 preferably has a narrow vertical extent or area generally perpendicular to the horizontal orientation of the stamp for obscuring the white security indicium 52. Not only is the first security indicium 52 camouflaged white in appearance, but it is also minuscule in size and imperceptible to the untrained eye, and it is inconspicuously located at the left edge of the postage site normal to the orange band 44 for further hiding its existence from casual observation.

Since these several features of the first security indicium 52 cooperate to render extremely difficult the casual detection thereof, the stamp is preferably also configured for improving the security detection of the indicium 52 in the USPS. For example, the face sheet 22 is preferably configured in material composition to fluoresce under black light 46 as illustrated in FIG. 2. And, the first security indicium 52 is configured in chemical formulation of the white ink not to fluoresce under the black light. In this way, when the black light 46 is used for detecting authenticity or fraud of the internet stamp, an authentic first security indicium 52 will contrast visibly with the fluorescent face sheet.

Accordingly, one method of authenticating the internet stamp 38 is simply to visibly examine the stamp to discern the white first security indicium 52 from the different white of the underlying face sheet 22. Such distinction is readily observable to the trained eye.

Another method of authenticating the internet stamp is to expose the stamp to the black light 46 for fluorescing the face sheet and discerning whether the first security indicium 52 fluoresces or not.

FIG. 2 also illustrates a second security indicium 54 comprising a thermalchromatic, or thermochromatic, ink which is preferably blue, and is not reproducible by ordinary photocopying. Thermalchromatic inks are conventional and change appearance under heat.

In a preferred embodiment, the second security indicium 54 is configured to visibly fade under body heat by touching or rubbing for example. In this way, the internet stamp may be authenticated by simply touching or rubbing the second security indicium 54 as shown schematically in FIG. 2 for applying heat thereto, and observing whether the indicium 54 visibly fades or not. Fading under heat indicates an authentic indicium 54, whereas lack of fading is indicative of an ineffective or fraudulent security feature.

Whereas the first security indicium 52 is specifically configured to be hidden or minuscule, the second security indicium 54 is specifically configured to be seen and is therefore preferably majuscule in size and plainly visible to the naked eye. To improve the contrast of the two security features 52,54, the first indicium 52 extends vertically along the left side of the stamp and postage site 48, and the second indicium 54 is also disposed vertically but on the opposite or right side of the postage site along the opposite edges of the stamp.

In the preferred embodiment illustrated in FIG. 2, the second security indicium 54 preferably comprises a graphical scene which may be aesthetically pleasing to the observer.

The postage sheet described above is conveniently used by simply loading the preprinted postage sheet into the printer 16. The user then uses the PC 10 to access the internet 12 for obtaining postage by downloading from the USPS internet site.

The computer then drives the printer 16 for printing the internet stamp 38 with the internet postage indicia 50 in the initially blank postage site 48. One or more of the internet stamps 38 may be printed in a single pass through the printer as desired.

The so printed internet stamp is then simply removed individually from the liner 24 by being peeled away therefrom as shown in both FIGS. 1 and 2 and then adhered to the mailer or envelope 20 in the ordinary manner for providing postage therefor. Since the internet stamp includes multiple security features, including the first and second security indicia 52,54, it does not require corresponding mailing labels to be simultaneously printed as in conventional practice, and may be conveniently mailed on the envelope at any time not within the 24 hour previous requirement.

The USPS may readily authenticate the user-printed internet stamp 38 by examining its various security features including the first and second security indicia 52,54 as described above.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A postage sheet for receiving printed postage, comprising:

a white face sheet having an exposed front side and an opposite back side covered with an adhesive;

a release liner having a front side covered with a release agent and bonded to said back side of said face sheet by said adhesive therebetween;

said face sheet including a removable internet stamp having a diecut perimeter, with said stamp having disposed on said front side thereof a visible ink microprint security indicium different in white color than said face sheet and not reproducible by electrostatic photocopying due to said white on white configuration resulting in a single hue of white obliterating the original distinction between said white indicium and said white face sheet; and said stamp further includes a blank postage site for printing internet postage indicia, and a fluorescent facing feature disposed adjacent said site for automated scanning of said stamp in the postal service, and said security indicium is preprinted adjacent said site; and wherein said security indicium and said facing feature are preprinted on said face sheet prior to printing said postage indicia on said blank postage site.

2. A postage sheet according to claim 1 wherein said security indicium is minuscule in size and not readily visible to the untrained eye.

3. A postage sheet according to claim 1 wherein said stamp has a horizontal orientation for printing said postage indicia horizontally, and said security indicium has a narrow vertical extent for obscuring said security indicium.

4. A postage sheet according to claim 1 wherein said face sheet is configured to fluoresce under black light, and said security indicium is configured not to fluoresce under said black light.

5. A postage sheet according to claim 1 further comprising a second non-photocopyable security indicium comprising thermalchromatic ink.

6. A postage sheet according to claim 5 wherein said second security indicium is majuscule in size and plainly visible to the naked eye.

7. A postage sheet according to claim 5 wherein said second security indicium is blue.

8. A postage sheet according to claim 5 wherein said second security indicium is configured to visibly fade under body heat.

9. A postage sheet according to claim 5 wherein said second security indicium comprises a graphical scene.

10. A postage sheet according to claim 1 further comprising a plurality of said internet stamps arranged in a rectangular array on said face sheet, with each stamp having a respective diecut perimeter, and being separately removable from said liner.

11. A postage sheet according to claim 10 wherein said face sheet includes a border surrounding each of said stamps for permitting overprinting of said stamps along said border.

12. A method of using said postage sheet according to claim 2 comprising:

loading said postage sheet into a printer;

using a personal computer to access the internet for obtaining postage;

printing said internet stamp with said internet postage indicia in said blank postage site; and removing said printed internet stamp from said liner and adhering said stamp to a mailer for providing postage therefor.

13. A postage sheet for receiving printed postage, comprising:

a white fluorescent face sheet having an exposed front side and an opposite back side covered with an adhesive;

a release liner having a front side covered with a release agent and bonded to said back side of said face sheet by said adhesive therebetween;

said face sheet including a removable internet stamp having a diecut perimeter, with said stamp having disposed on said front side thereof a nonfluorescent visible microprint security indicium different in shade of white than said white face sheet and not reproducible by electrostatic photocopying due to said different white on white configuration, with a photocopied stamp having a single hue of white obliterating the original distinction between said white indicium and said white face sheet; and said stamp further includes a blank postage site for printing internet postage indicia, and a fluorescent facing feature disposed adjacent said site for automated scanning of said stamp in the postal service, and said security indicium is preprinted adjacent said site; and wherein said security indicium and said facing feature are preprinted on said face sheet prior to printing said postage indicia on said blank postage site.

14. A postage sheet according to claim 13 wherein said stamp has a horizontal orientation for printing said postage indicia horizontally, and said security indicium has a narrow vertical extent for obscuring said security indicium.

15. A postage sheet according to claim 14 wherein said face sheet is configured to fluoresce under black light, and said security indicium is configured not to fluoresce under said black light.

16. A method of authenticating said internet stamp according to claim 15 comprising visibly examining said stamp to discern said white security indicium from said white face sheet.

17. A method according to claim 16 further comprising exposing said internet stamp to black light for fluorescing said face sheet and discerning whether said white security indicium fluoresces or not.

18. A postage sheet comprising: a white face sheet having an exposed front side and an opposite back side covered with an adhesive; a release liner having a front side covered with a release agent and bonded to said back side of said face sheet by said adhesive therebetween; said face sheet including a removable internet stamp having a diecut perimeter, with said stamp having disposed on said front side thereof a visible first microprint security indicium different in shade of white than said white face sheet, and a visible second security indicium comprising thermalchromatic ink different in color than said white face sheet, with both said first and second security indicia not being reproducible by electrostatic photocopying, wherein said first security indicia is not reproducible by electrostatic photocopying due to said white on white configuration resulting in a single hue of white obliterating the original distinction between said white indicium and said white face sheet; and said stamp further includes a blank postage site for printing internet postage indicia, and said first and second security indicia are preprinted adjacent said site.

19. A postage sheet according to claim 18 wherein:

said first security indicium is minuscule in size and not readily visible to the untrained eye; and said second security indicium is majuscule in size and plainly visible to the naked eye.

20. A postage sheet according to claim 19 wherein said second security indicium comprises a graphical scene.

21. A postage sheet according to claim 20 wherein said stamp has a horizontal orientation for printing said postage indicia horizontally, and said first security indicium has a narrow vertical extent disposed on one side of said postage site for obscuring said first security indicium, and said second security indicium is disposed on an opposite side of said postage site.

22. A postage sheet according to claim 21 wherein:

said face sheet is configured to fluoresce under black light, and said first security indicium is configured not to fluoresce under said black light; and said second security indicium is configured to visibly fade under body heat.

23. A postage sheet according to claim 22 further comprising a plurality of said internet stamps arranged in a rectangular array on said face sheet, with each stamp having a respective diecut perimeter, and being separately removable from said liner.

24. A postage sheet according to claim 23 wherein said face sheet includes a border surrounding each of said stamps for permitting overprinting of said stamps along said border.

25. A postage sheet according to claim 23 further comprising a facing feature including a colored band disposed along the bottom horizontal edge of said stamp below said blank postage site.

* * * * *